United States Patent [19]

Lind et al.

[11] Patent Number: 4,933,248

[45] Date of Patent: Jun. 12, 1990

[54] ELECTROPHOTOGRAPHIC RECORDING MATERIAL

[75] Inventors: Erwin Lind; Franz Freimuth, both of Wiesbaden, Fed. Rep. of Germany

[73] Assignee: Hoechst Aktiengesellschaft, Frankfurt am Main, Fed. Rep. of Germany

[21] Appl. No.: 295,759

[22] Filed: Jan. 11, 1989

[30] Foreign Application Priority Data

Jan. 12, 1988 [DE] Fed. Rep. of Germany ..... 3800617

[51] Int. Cl.[5] ..... G03G 5/06

[52] U.S. Cl. ..... 430/83; 430/49; 430/96

[58] Field of Search ..... 430/96, 83

[56] References Cited

U.S. PATENT DOCUMENTS

| | | | |
|---|---|---|---|
| 3,869,292 | 3/1975 | Peters | 430/176 X |
| 4,028,340 | 6/1977 | Kanezaki . | |
| 4,063,948 | 12/1977 | Lind . | |
| 4,153,461 | 5/1979 | Berghäuser et al. . | |
| 4,439,516 | 3/1984 | Cernigliaro et al. | 430/166 X |
| 4,528,256 | 7/1985 | Lind | 430/83 |
| 4,748,099 | 5/1988 | Shimada et al. | 430/96 X |

FOREIGN PATENT DOCUMENTS

| | | | |
|---|---|---|---|
| 45639 | 10/1985 | European Pat. Off. . | |
| 996315 | 6/1965 | United Kingdom . | |
| 1026144 | 4/1966 | United Kingdom | 430/72 |
| 2014748 | 6/1982 | United Kingdom . | |

OTHER PUBLICATIONS

IBM Technical Disclosure Bulletin, vol. 23, No. 2, Jul. 1980, p. 773.

"Journal of Polymer Science", Part A-1, vol. 7, (1969), pp. 2175-2184.

"Journal of Polymer Science", Part A-1, vol. 7, (1969), pp. 2405-2410.

Richard C. Sovish, "*Preparation and Polymerization of p-Vinylphenol*", Journal of Organic Chemistry, vol. 24,. (1959), pp. 1345-1347.

*Primary Examiner*—Roland E. Martin

*Attorney, Agent, or Firm*—Foley & Lardner, Schwartz, Jeffery, Schwaab, Mack, Blumenthal & Evans

[57] ABSTRACT

An electrophotographic recording material is disclosed that comprises an electrically conducting layer support being in particular suitable for the production of printing plates or printed circuits, and a photoconductive layer comprising an organic photoconductor, a phenolic resin as the binder, a sensitizer and customary additives. The binder employed is an optionally substituted polyvinylphenol which has a molecular weight (weight average) of preferably between 1,500 and 60,000. The polyvinylphenol may be halogenated, preferably brominated. Furthermore, an o-quinonediazide may be contained in the photoconductive layer. The recording material is distinguished by a high charging capacity, good photosensitivity and excellent solubility properties. It is suitable for the reproduction of fine image elements.

18 Claims, No Drawings

ELECTROPHOTOGRAPHIC RECORDING MATERIAL

BACKGROUND OF THE INVENTION

The present invention relates to an electrophotographic recording material comprising an electrically conducting layer support particularly suitable for the production of printing plates or printed circuits, and a photoconductive layer comprising an organic photoconductor, a phenolic resin as the binder, a sensitizer and customary additives.

A recording material of the above type is known (German Patent No. 25 26 720, equivalent to U.S. Pat. No. 4,063,948). Binders are included in this photoconductive layer which are soluble in aqueous or alkaline solvent systems. Such binders include high-molecular-weight substances which possess groups conferring solubility in alkaline media, such as acid, anhydride, carboxyl, phenolic, sulfonic acid, sulfonamide or sulfonimide groups. Binders having high acid numbers are particularly suitable. Although these layers have good electrophotographic properties, their solubility is still inadequate for applications where very small details have to be reproduced.

There has also been disclosed a process for the production of a printing form by electrophotographic means, where a material containing an o-quinonediazide in addition to an inorganic or organic photoconductor is employed for the photoconductive layer (German Patent No. 14 47 008, equivalent to British Patent No. 996,315). The binder contained in the layer is an organic natural or synthetic resin, advantageously a mixture of polyvinyl acetate and m-cresolformaldehyde novolak. However, the interactions of the individual components of these materials are not sufficiently matched with each other so that the process has not been able to gain general acceptance.

Furthermore, it is known to incorporate substituted phenolic resins as binders into photoconductive layers used for electrophotographic recording materials in the printing industry (German Auslegeschrift 29 04 183, equivalent to British Patent No. 2,014,748). The resins are obtained by condensing aldehydes or ketones with phenols carrying relatively long-chain substituents. Due to their hydrophobic character, hydrophilic substituents must additionally be present on the phenol nucleus, such as hydroxy, amino or carboxy groups. It has, however, been found that the solubility of these layers is insufficient and that stripping is only possible to a limited extent and using strongly basic stripping agents.

On the other hand, mixtures are known which contain photosensitive compounds, such as o-quinonediazides, and phenol condensates, such as novolaks. Upon exposure to UV light, their solubility in aqueous-alkaline solutions changes due to decomposition reactions of the photosensitive compounds. It is also possible to use polymers or copolymers possessing vinyl phenol units instead of the novolak component (German Patent No. 23 22 230, equivalent to U.S. Pat. No. 3,869,292). The publication does not mention the suitability of the mixtures for electrophotographic applications.

It is also known to employ mixtures of photosensitive compounds and poly(p-vinyl phenol) as binders for photosensitive layers which are suitable for electron beam irradiation. If they contain bromine-substituted compounds, mixtures of this type in particular undergo crosslinking reactions upon exposure and are thus suitable for negative-working photoimaging processes (*IBM Technical Disclosure Bulletin,* Vol. 23, No. 2, July 1980, p. 773; European Patent No. 0,045,639).

SUMMARY OF THE INVENTION

It is therefore an object of the instant invention to provide an electrophotographic recording material which satisfies even very high demands; which does not exhibit the disadvantages of the known materials; which is discharged to a high degree in the dark; upon which a toner image can be produced by development with dry or liquid toner; and which can be readily developed or stripped with environmentally acceptable aqueous-alkaline solutions so that high-quality printing forms are obtained.

These and other objects are achieved by providing an electrophotographic recording material which uses an optionally substituted polyvinylphenol as a binder in the photoconductive layer. The electrophotographic recording material comprises an electrically conducting layer support and a photoconductive layer comprising an organic photoconductor, a polyvinylphenol resin binder, and a sensitizer. Electrically conducting layer supports suitable for the production of printing plates and printed circuits are preferred. Preferably, a polyvinylphenol having a molecular weight (weight average) of between 1,500 and 60,000 is present in the layer. The polyvinylphenol according to this invention preferably is a polymer of p-vinylphenol. Preferably, a halogen-substituted polyvinylphenol is employed.

Thus, a recording material for the production of printing forms or printed circuits is provided that has improved electrophotographic properties, in particular with regard to its chargeability, photosensitivity and solubility in aqueous-alkaline solutions and that exactly reproduces small image elements and gives long print runs.

Other objects, features and advantages of the present invention will become apparent from the following detailed description. It should be understood, however, that the detailed description and the specific examples, while indicating preferred embodiments of the invention, are given by way of illustration only, since various changes and modifications within the spirit and scope of the invention will become apparent to those skilled in the art from this detailed description.

DETAILED DESCRIPTION OF THE PREFERRED EMBODIMENTS

The preparation of vinylphenol polymers is known (German Offenlegungsschrift 26 08 407; *Journal of Polymer Science,* Part A-1, Vol. 7, 1969, pp. 2175 to 2184 and 2405 to 2410; or *Journal of Organic Chemistry,* Vol. 24, 1959, pp. 1345 to 1347). It involves dehydrogenating ethylphenol to convert it into vinylphenol, polymerizing the raw product thus obtained by a free-radical or cationic method, and purifying the polymerization product. The halogen-substituted polymers are prepared, for example, by brominating the vinylphenol polymer.

The halogenated vinylphenol polymers employed in accordance with this invention preferably are chlorinated or brominated polymers, in particular brominated polymers.

Apart from vinylphenol homopolymers, copolymers of vinylphenols and other vinyl compounds, such as styrene or acrylates, can also be used. In general, the homopolymers of p-vinylphenol are preferred. The halogenated polyvinylphenols usually have a halogen content of about 20% to 60% by weight, preferably of about 40% to 60% by weight.

In a particular embodiment, the photoconductive layer according to this invention contains an o-quinonediazide, preferably an o-naphthoquinonediazide. In this embodiment the photoconductive layer can be subjected to a second exposure with UV light following development (toner application), so that a particularly ready solubility of the exposed areas in the subsequent stripping step is achieved. The applied toner image need not be fixed. It is completely surprising to find that the electrophotographic properties of the photoconductive layer are not adversely affected by the addition of the photosensitive substance to the photoconductive layer and that a good chargeability and low dark discharge rate are accomplished. Furthermore, the recording material has a long shelf life.

As a rule, the photoconductive layer contains about 5% to 40% by weight of o-quinonediazide. Preferably, about 15% to 25% by weight of o-quinonediazide are present in the layer. Thereby, an excellent reproduction of tiny image elements, such as fine screen dots, is made possible.

Suitable layer supports for the recording material of this invention for the production of printing forms and printed circuits include all materials which are commonly employed for this purpose, such as plates of aluminum, zinc, magnesium or copper or multimetal plates, but also cellulose products, such as special papers or films of cellulose hydrate, cellulose acetate or cellulose butyrate, particularly in its partly hydrolyzed form. To a limited extent, plastic materials, such as polyamide films or films coated with metal by vaporization, can also be used as layer supports.

Surface-modified aluminum foils have been found to be particularly useful. The surface modification comprises a mechanical or electrochemical graining which is optionally followed by an anodic oxidation and treatment with polyvinylphosphonic acid, in accordance with German Offenlegungsschrift 16 21 478, equivalent to U.S. Pat. No. 4,153,461. These treatments provide for longer print runs and reduce the risk of oxidation.

The organic photoconductors contained in the photoconductive layer are known. They include triphenylamine derivatives, relatively highly condensed aromatic compounds, such as anthracene, benzocondensed heterocyclic compounds, such as benzthiazoles, derivatives of pyrazoline, imidazole or triazole, oxadiazole derivatives, such as 2,5-bis(4,-diethylaminophenyl)oxadiazole-1,3,4, oxazole derivatives, such as 2-phenyl-4-(2,-chlorophenyl)-5(4''-diethylaminophenyl)-oxazole, and also vinylaromatic polymers, such as polyvinylanthracene, polyacenaphthylene or polyvinylcarbazole and copolymers thereof which are compatible with polyvinylphenol and suited to achieve a differentiation in solubility.

The optionally added o-quinonediazides preferably are o-napthoquinonediazides, such as the diesters or trisesters obtained from 2,3,4trihydroxybenzophenone and naphthoquinone-(1,2)-diazide-(2)-5-sulfonic acid or -4-sulfonic acid, esters, in particular the diesters obtained from bis(2-hydroxynaphthyl)-methane and naphthoquinone(1,2)-diazide-(2)-5-sulfonic acid, and esters obtained from 2-phenyl-2-(4'-hydroxyphenyl)propane and naphthoquinone-(1,2)-diazide-(2)-4-sulfonic acid. Esters obtained from hydroxyl-group-containing polymers and naphthoquinonediazide sulfonic acids are likewise suited. Mixtures of several of the above mentioned quinonediazide sulfonic acid esters can also be employed successfully.

Additionally, further binders can be contained in the photoconductive layer. They are added to improve the film-forming properties of the layer, to increase the adhesion between the layer and the support and to extend the print run.

Such binders include, for example, copolymers of styrene and maleic anhydride and partly esterified products thereof, polyvinylacetates and copolymers thereof with crotonic acid, phenolic resins, coumaroneindene resins, polyacrylates and copolymers thereof with acrylic acid, colophony and reaction products thereof, maleate resins and phthalate resins.

To expand the region of spectral sensitivity, the recording materials of this invention contain at least one sensitizing dye. Suitable dyes include, for example, Malachite Green (C.I. No. 42,000), Crystal Violet (C.I. No. 42,555), Methyl Violet (C.I. No. 42,535), Night Blue (C.I. No. 44,085), Victoria Blue (C.I. No. 44,045 and No. 52,595:2, respectively), Rhodamine B, Rhodamine FB (C.I. No. 45,170), Capri Blue (C.I. No. 51,015), Methylene Blue (C.I. No. 52,015), Fuchsine (C.I. No. 42,500), Rose Bengal (C.I. No. 45,440), polymethine dyes, such as Astrazone Orange G (C.I. No. 48,035) Astrazone Orange R (C.I. No. 48,040), Astrazone Yellow 3G (C.I. No. 48,055), Astrazone Yellow 5G (C.I. No. 48,065) or Astrazone Red Violet (C.I. No. 48,013).

Furthermore, conventional additives, such as flow control or levelling agents or plasticizers, may be contained in the photoconductive layer of the recording material according to this invention, and/or adhesion promoters may be present between the layer support and the photoconductive layer.

The interaction between the photoconductor and the optionally present o-quinonediazide is not substantially influenced by the presence of the above additive(s).

A more detailed description of the production and handling of the recording material of this invention is given by way of the examples which follow.

EXAMPLE 1

2,5-Bis-(4'-diethylaminophenyl)-oxadiazole1,3,4 (50 g), 50 g of poly-p-vinylphenol resin (Resin M, made by Maruzen Oil Co., Ltd., Osaka, Japan) and 250 mg of Rhodamine FB (C.I. No. 45,170) are dissolved in a mixture of 225 ml of ethylene glycol monomethyl ether, 360 ml of tetrahydrofuran and 90 ml of butyl acetate. The solution is coated onto a 300 μm thick, electrochemically grained and anodically oxidized aluminum plate, which has additionally been treated with polyvinylphosphonic acid, such that a photoconductor layer having a thickness of 5.5 μm is obtained after evaporation of the solvent.

The photosensitivity of the layer is measured by first charging the layer to −500 V and then exposing it to white filament lamp light, until a discharge down to −60 V is achieved. The energy density required is 320 $\mu J/cm^2$.

To produce an image, the photoconductor layer is charged to a surface potential of −500 V by means of a corona and is then imagewise exposed in a reprographic camera for 20 seconds, using eight halogen lamps of 500 W each. The resulting latent charge image is developed with a customary toner/support developer mixture, employing a magnetic roller. The developed image is fixed by heat radiation.

For converting the plate into a printing form, it is immersed for two minutes into a solution obtained by dissolving 20 g of $Na_2SiO_3x9\ H_2O$ and 2 g of NaOH in a mixture comprising 728 g of water, 100 g of n-propanol and 150 g of ethylene diglycol. The layer portions not covered by the toner image are then removed by means of a water jet with slight rubbing. The printing form thus obtained is distinguished by a good reproduction of screened and full shade areas. In a sheet-fed offset press more than 100,000 prints are obtained from the form.

When the 50 g of poly-p-vinylphenolic resin contained in the above-described coating solution are replaced by a novolak obtained from m-cresol and formaldehyde (Alnovol ®429K from Hoechst AG) the resulting printing plate requires an energy density of 520 $\mu J/cm^2$ for being discharged from -500 V to -60 V, and exposure in a reprographic camera must be performed during 30 seconds. The residence time in the developer or stripper described above is six minutes.

EXAMPLE 2

2-Vinyl-4- (2'- chlorophenyl) -5- (4'-diethylaminophenyl)-oxazole (35 g) and 40 g of polyvinylphenol are dissolved in a mixture of 160 ml of ethylene glycol monomethyl ether, 270 ml of tetrahydrofuran and 60 ml of butyl acetate. To this mixture are added 440 mg of Astrazone Orange R (C.I. No. 48,040) and 350 mg of Astrazone Red Violet 3 RN (C.I. No. 48,013). An aluminum plate which has been superficially grained by wet-brushing, anodically oxidized and treated with polyvinylphosphonic acid is coated with the resulting solution, in a way such that the photoconductor layer has a weight of 5.5 $g/m^2$. The plate is charged (-500 V) and exposed as described in Example 1, whereby an exposure time of 14 seconds is sufficient to achieve an image which is rich in contrast and free from scum. The latent electrostatic charge image is rendered visible with a dry developer and fixed by heat radiation. Then the plate is passed through a customary developing or stripping apparatus where the non-imaged layer areas are removed at a rate of 1.1 m/min.

EXAMPLE 3

A brominated polyvinylphenol resin (30 g of Resin MB from Maruzen Oil, Japan), 30 g of copolymer of styrene and maleic anhydride, 40 g of 2,5-bis-(4'-diethylaminophenyl)-oxadiazole-1,3,4, 10 g of a condensation product obtained from benzophenone-2carboxylic acid and diethyl aniline, and 250 mg of Rhodamine FB (C.I. No. 45,170) are dissolved in a mixture of 280 ml of propylene glycol monomethyl ether, 100 ml of tetrahydrofuran and 200 ml of butyl acetate. An aluminum plate is coated with the resulting solution and dried, as described in Example 1.

The plate is charged to −500 V and imagewise exposed in a reprographic camera for 18 seconds, using 10 halogen lamps of 600 W each, and is then developed and fixed in known manner. Thereafter, the photoconductor layer is removed from the areas, which are not covered by toner, with the solution described in Example 1. The print run and quality achieved with the printing form are excellent.

EXAMPLE 4

Polyvinylphenol (40 g) having an average molecular weight of 1,700 (weight average), 40 g of 2,5-bis-(4'-diethylaminophenyl)-oxadiazole-1,3,4, 20 g of 2,3,4-trihydroxybenzophenone-naphthoquinone-(1,2)-diazide-(2)-5-sulfonic acid trisester, 500 mg of Astrazone Orange R (C.I. No. 48,040) and 200 mg of Rhodamine FB (C.I. No. 45,170) are dissolved in a solvent mixture comprising 200 ml of propylene glycol monomethyl ether, 100 ml of tetrahydrofuran and 200 ml of butyl acetate. The resulting solution is coated onto a 300 μm thick aluminum foil which has been electrochemically grained, anodically oxidized and treated with polyvinylphosphonic acid, in a way such that a 5 μm thick photoconductor layer is obtained after evaporation of the solvents. The layer is charged to −500 V and exposed in a reprographic camera as described in Example 1. The toner image obtained by development is not fixed. The plate carrying the toner image is exposed again for two minutes in a customary automatic copying apparatus under a 5 kW metal halide lamp (Violight). Then the toner image is removed by rinsing with water, and the plate is immersed for 30 seconds into a developing or stripping solution having the same composition as that described in Example 1, rinsed with water and wiped. Screened images are, in particular, more clearly reproduced by the printing form thus obtained than by the printing forms according to Examples 1 to 3.

When a cresol/formaldehyde novolak is used instead of the polyvinylphenol, the time required for imaging in the reprographic camera is 30 seconds instead of 20 seconds. The residence time in the developing or stripping agent is two minutes.

EXAMPLE 5

Brominated polyvinylphenol (24 g of Resin MB from Maruzen Oil Co., Ltd., Japan), 24 g of a styrene/maleic anhydride copolymer which is partly esterified with isobutanol, 42 g of 2-phenyl-4-(2'-chlorophenyl)-5(4'-diethyl-aminophenyl)-oxazole, 30 g of 2,3,4-trihydroxybenzophenone-naphthoquinone-(1,2)-diazide-(2)5-sulfonic acid trisester, 525 mg of Astrazone Orange R and 210 mg of Rhodamine FB are dissolved in a mixture comprising 250 ml of propylene glycol monomethyl ether, 125 mg of tetrahydrofuran and 250 ml of butyl acetate. The resulting solution is coated onto an anodically oxidized aluminum foil, as described in Example 4. By electrophotographic means a toner image is produced on the coated foil, but without fixing. A second exposure is then performed as described in Example 4, in order to decompose the quinonediazide contained in the layer, and the toner image is rinsed off with water. For conversion into a printing form, the plate is immersed for 30 seconds into the developing or stripping solution of Example 1 and rinsed and wiped with water. A planographic printing form having excellent image reproduction properties and giving long print runs is obtained.

What is claimed is:

1. An electrophotographic recording material, comprising:

an electrically conducting layer support;

a photoconductive layer comprising an organic photoconductor, a polyvinylphenol resin binder, and a sensitizer.

2. A recording material as claimed in claim 1, wherein the polyvinylphenol has a molecular weight (weight average) of between 1,500 and 60,000.

3. A recording material as claimed in claim 1, wherein the polyvinylphenol is a polymer of pvinylphenol.

4. A recording material as claimed in claim 1, wherein the polyvinylphenol is halogenated.

5. A recording material as claimed in claim 4, wherein the polyvinylphenol is brominated.

6. A recording material as claimed in claim 1, wherein the photoconductive layer additionally comprises an o-quinonediazide.

7. A recording material as claimed in claim 1, wherein the photoconductive layer additionally comprises an o-naphthoquinonediazide.

8. An electrophotographic recording material as claimed in claim 1, wherein the electrically conducting layer support is suitable for the production of printing plates and printed circuits.

9. An electrophotographic recording material as claimed in claim 1, additionally comprising at least one selected from the group consisting of flow control agents and plasticizers.

10. An electrophotographic recording material as claimed in claim 1, additionally comprising an adhesion promoter between the layer support and the photoconductive layer.

11. An electrophotographic recording material as claimed in claim 6, wherein the photoconductive layer comprises from 5% to 40% by weight of o-quinonediazide.

12. An electrophotographic recording material as claimed in claim 6, wherein the photoconductive layer comprises from 15% to 25% by weight of o-quinonediazide.

13. An electrophotographic recording material as claimed in claim 7, wherein the photoconductive layer comprises from 5% to 40% by weight of o-naphthoquinonediazide.

14. An electrophotographic recording material as claimed in claim 7, wherein the photoconductive layer comprises from 15% to 25% by weight of o-naphthoquinonediazide.

15. An electrophotographic recording material as claimed in claim 4, wherein the polyvinylphenol has a halogen content of 20% to 60% by weight.

16. An electrophotographic recording material as claimed in claim 4, wherein the polyvinylphenol has a halogen content of 40% to 60% by weight.

17. An electrophotographic recording material as claimed in claim 5, wherein the polyvinylphenol has a bromine content of 20% to 60% by weight.

18. An electrophotographic recording material as claimed in claim 5, wherein the polyvinylphenol has a bromine content of 40% to 60% by weight.

* * * * *